US011735850B2

(12) United States Patent
Li et al.

(10) Patent No.: US 11,735,850 B2
(45) Date of Patent: Aug. 22, 2023

(54) CONNECTOR ASSEMBLY

(71) Applicant: Tyco Electronics (Shanghai) Co. Ltd., Shanghai (CN)

(72) Inventors: Lizhou (Leo) Li, Shanghai (CN); Xinjie (David) Zhang, Kunshan (CN); Hongjian (Neil) Ni, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 24 days.

(21) Appl. No.: 17/404,335

(22) Filed: Aug. 17, 2021

(65) Prior Publication Data

US 2022/0059959 A1 Feb. 24, 2022

(30) Foreign Application Priority Data

Aug. 19, 2020 (CN) ..... 202010836721.1
Aug. 27, 2020 (CN) ..... 202010877621.3

(51) Int. Cl.
*H01R 12/75* (2011.01)
*H01R 12/72* (2011.01)
*H01R 12/71* (2011.01)

(52) U.S. Cl.
CPC ..... *H01R 12/75* (2013.01); *H01R 12/714* (2013.01); *H01R 12/724* (2013.01)

(58) Field of Classification Search
CPC .... H01R 23/725; H01R 23/722; H01R 9/096; H01R 13/75; H01R 13/724; H01R 13/714
USPC ..... 439/502, 62, 65, 61, 329, 908, 493
See application file for complete search history.

(56) References Cited

U.S. PATENT DOCUMENTS 4,060,889 A * 12/1977 Zielinski ..... H01R 12/79 174/268
6,244,881 B1 * 6/2001 Hara ..... H01R 13/7034 439/61
6,336,826 B1 * 1/2002 Kraft ..... H01R 13/6463 439/502
6,540,548 B1 * 4/2003 Zhang ..... H01R 43/28 439/98
7,338,332 B2 * 3/2008 Simonsson ..... H01R 4/4881 439/495
7,606,041 B2 * 10/2009 Park ..... H05K 3/363 429/129
7,734,083 B2 * 6/2010 Teramoto ..... H05K 1/028 382/152
7,993,157 B2 * 8/2011 Azizi-Namini .... H01R 13/5812 439/469
8,210,867 B2 * 7/2012 Kojima ..... H01R 9/0515 439/83
8,562,149 B2 * 10/2013 Hu ..... G03B 21/145 353/57
2003/0027434 A1 * 2/2003 Homer ..... H01R 27/00 439/61

(Continued)

*Primary Examiner* — Gary F Paumen
(74) *Attorney, Agent, or Firm* — Barley Snyder

(57) ABSTRACT

A connector assembly comprises a circuit board having a front side and a back side, and two first connectors mounted side by side on the front side of the circuit board. A cable includes a plurality of wires divided into two groups, with each of the groups of wires being electrically connected on one end to a respective one of the first connectors via the circuit board.

20 Claims, 3 Drawing Sheets

(56) References Cited

U.S. PATENT DOCUMENTS

2014/0287616 A1* 9/2014 Chen ..... H01R 13/5812
439/493
2015/0325937 A1* 11/2015 Mikage ..... H01R 12/78
439/493

* cited by examiner

CONNECTOR ASSEMBLY

CROSS-REFERENCE TO RELATED APPLICATIONS

This application claims the priority benefit of Chinese Patent Application No. 202010877621.3 filed on Aug. 27, 2020, and Chinese Patent Application No. 202010836721.1 filed on Aug. 19, 2020, the whole disclosures of which are incorporated herein by reference.

FIELD OF THE INVENTION

The present disclosure relates to a connector assembly, and more particularly, to a connector assembly with a cable.

BACKGROUND

Electrical connectors often need to be connected to an associated cable and via a circuit board. Generally, the connector is installed on a front side of the circuit board, and the cable is located under a back side of the circuit board. A plurality of wires of the cable are then bent and extended to the circuit board to establish an electrical connection therewith. Typically, there is only a single connector on the circuit board, and thus each of the wires of the cable must be routed and electrically connected to the single connector. Therefore, all the wires of the cable are required to be arranged in a row and bent toward the circuit board. This results in a large density of wiring, which creates significant difficulties in bending the wires, as well as occupies a large amount of space. Thus, the height and width dimensions of the connector assembly as a whole are increased, and the performance and quality of the connector assembly is decreased due to the required excessive bending of the wires.

SUMMARY

A connector assembly according to an embodiment of the present disclosure comprises a circuit board having a front side and a back side, with two first connectors mounted side by side on the front side of the circuit board. The assembly further includes a cable having a plurality of wires divided into two groups, with each group of wires being electrically connected on one end to a respective one of the first connectors via the circuit board.

BRIEF DESCRIPTION OF THE DRAWINGS

The invention will now be described by way of example with reference to the accompanying Figures, of which.

DETAILED DESCRIPTION OF THE EMBODIMENTS

Figure 1:
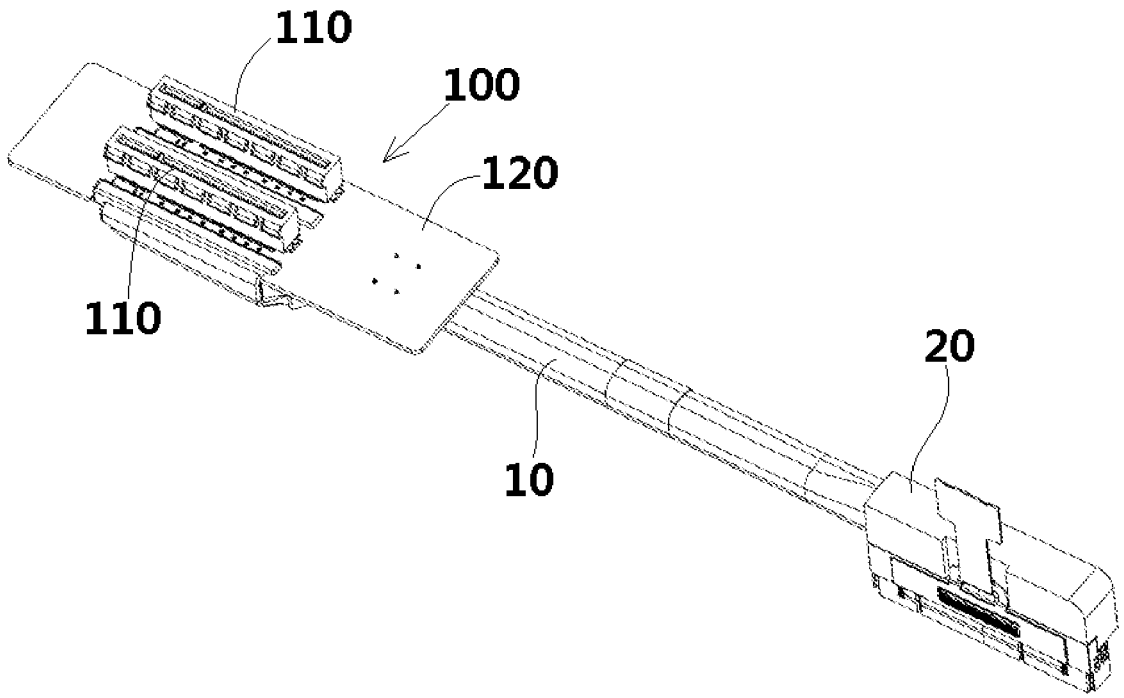
FIG. 1 shows a schematic perspective view of a connector assembly according to an exemplary embodiment of the present disclosure.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to an embodiment of the present disclosure, a connector assembly comprises a circuit board having a front side and a back side, with two first connectors installed side by side on the front side of the circuit board. A cable of the assembly includes a plurality of wires, each having one end electrically connected to the two first connectors via the circuit board. The plurality of wires are divided into two groups, with each group connected to a respective one of the two first connectors. Embodiments of the present disclosure divide what is typically a single connector and associated cable into a multi-connector assembly, thereby reducing the size of the required connectors and the density of the wiring that must be routed to each connector.

Referring generally to FIGS. 1-5, in the illustrated embodiment, the connector assembly includes two first connectors 110, a circuit board 120 and a cable 10. The circuit board 120 has a front side and a back side. The first connectors 110 are installed side by side in parallel on the front side of the circuit board 120, with one end of the cable 10 electrically connected to the first connectors 110. The plurality of wires 11 of the cable 10 are divided into two groups, with each group of wires 11 electrically connected to a respective one of the two first connectors 110. One end of the cable 10 extends to reach a position under the back side of the circuit board 120.

Each group of wires 11 of the cable 10 are arranged in a row and welded to the circuit board 120 so as to be electrically connected to the first connector 110 via conductive traces on the circuit board 120. Specifically, the two groups of wires 11 of the cable 10 are welded to a row of first welding pads on the front side of the circuit board 120 and a row of second welding pads on the back side of the circuit board 120, respectively. The connector assembly further comprises two insulation cladding bodies 130 molded on the circuit board 120 and used to clad respective welded portions of the two groups of wires 11 welded to the circuit board 120.

Figure 2:
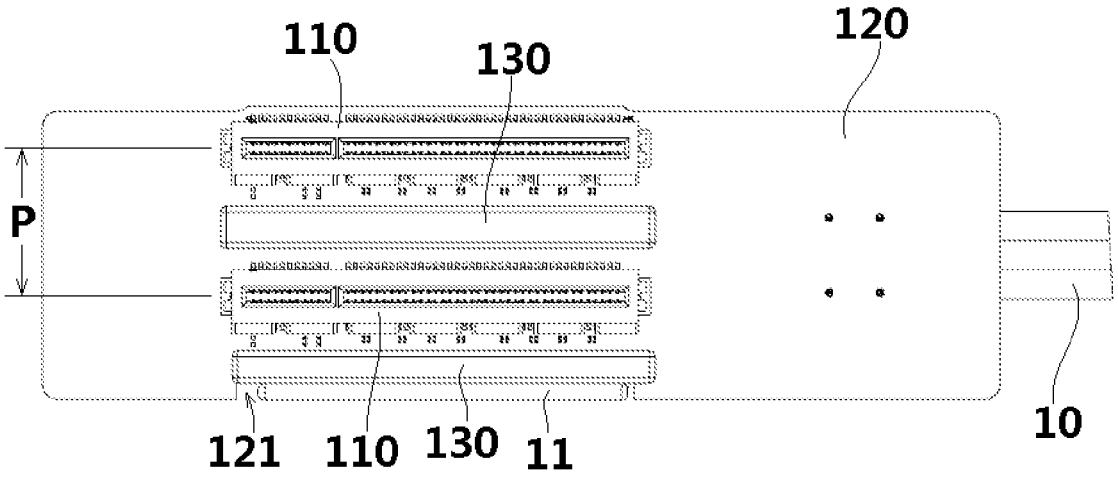
FIG. 2 shows a schematic diagram of the connector assembly shown in FIG. 1 viewed from a front side.
Figure 3:
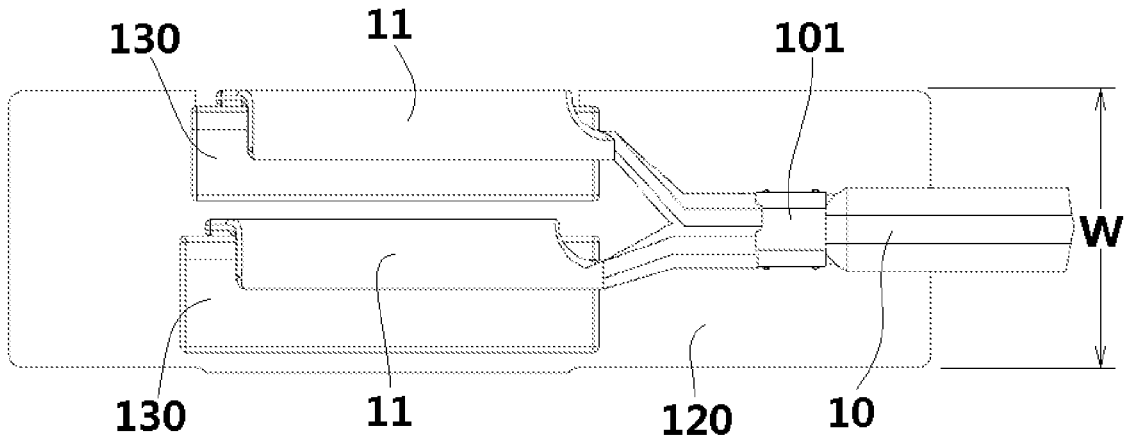
FIG. 3 shows a schematic diagram of the connector assembly shown in FIG. 1 viewed from a back side.
Figure 4:
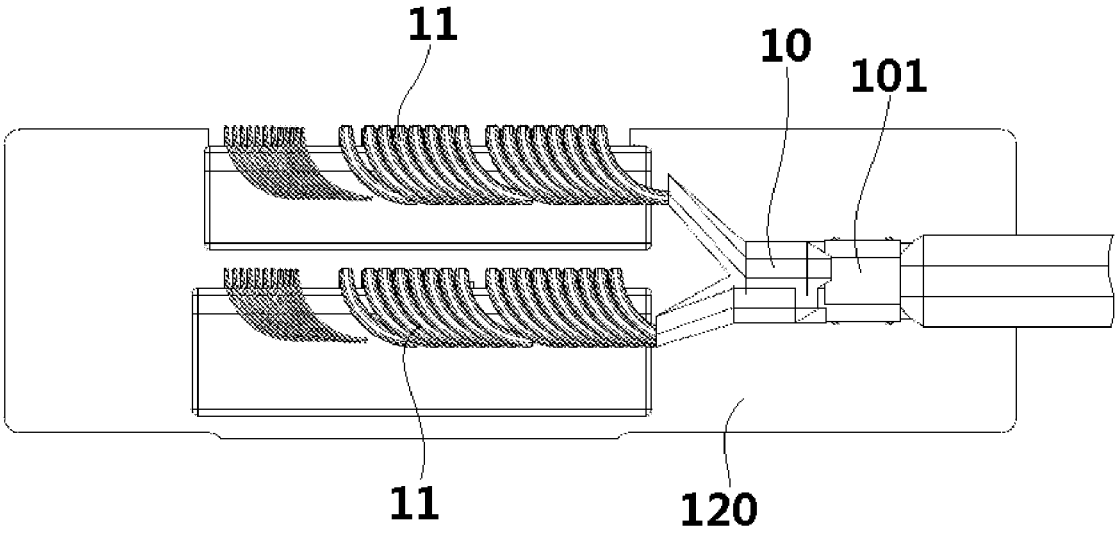
FIG. 4 shows a schematic diagram of the connector assembly shown in FIG. 3 viewed from the back side, in which an insulation tape wrapped on the wires is removed, and the wires are directly exposed.
Figure 5:
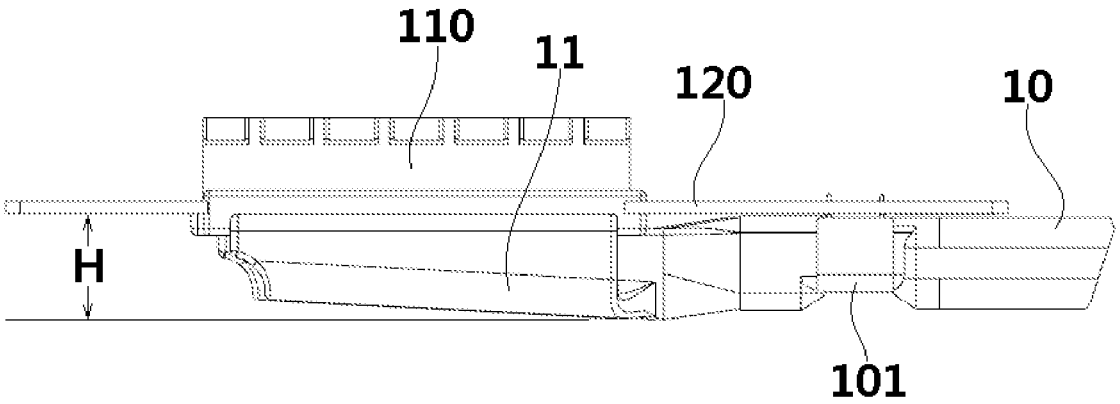
FIG. 5 shows a schematic diagram of the connector assembly shown in FIG. 1 viewed from a lateral side.

In the illustrated embodiment, the circuit board 120 has a length direction and a width direction. The first two connectors 110 are elongated and extend along the length direction of the circuit board 120. The two first connectors 110 are separated by a predetermined distance or interval P in the width direction, with the predetermined distance P not being greater than 20.32 mm, as shown in FIG. 2. In an exemplary embodiment of the present disclosure the predetermined interval P may be equal to 20.32 mm, 20 mm, 19 mm, 18 mm, 17 mm, 16 mm or 15 mm.

The cable 10 extends along the length direction of the circuit board 120 to reach a position under the back side of the circuit board 120. Thereunder, each group of wires 11 of the cable 10 is bent so that it extends from the one end of the cable 10 along a curved path, which is oriented approximately perpendicular to the length direction of the circuit board 120, to reach a position above the circuit board 120. In the illustrated embodiment, a curved portion of each group of wires 11 of the cable 10 extending along the curved path has a height H of not greater than 15 mm in a direction perpendicular to the circuit board 120. The height H of the curved portion of each group of wires 11 of the cable 10 may be equal to 15 mm, 14 mm, and 13 mm, 12 mm, 11 mm or 10 mm. The width W of the whole connector assembly 100 in the width direction of the circuit board 120 is not greater than 39.5 mm and may be equal to 39.5 mm, 38 mm, 36 mm, 34 mm, 32 mm or 30 mm.

In the illustrated embodiment, a longitudinal edge of the circuit board 120 is formed with a notch 121 recessed inwardly, and one group of wires 11 of the cable 10 pass through the notch 121 to extend from the back side to the front side of the circuit board 120 and be welded to the front side of the circuit board 120. In one embodiment, the first connectors 110 are aligned longitudinally with the notch, and are arranged laterally offset with respect to a center of the circuit board in a direction away from the notch, as shown in FIG. 2, thereby creating additional space for the routing of one of the groups of wires 11.

The connector assembly 100 further comprises a fixing clip 101 installed on the back side of the circuit board 120 and used to fix the one end of the cable 10 onto the back side of the circuit board 120. The other end of the cable 10 is electrically connected to a second connector 20 such that the second connector is electrically connected to the two first connectors 110 via the cable 10 and the circuit board 120.

Embodiments of the present disclosure benefit by dividing what is typically a single connector assembly and associated cable into a multi-connector assembly (e.g., a two connector assembly), thereby reducing the size of the required connectors. Moreover, as the required plurality of wires of the cable are able to be divided into two groups, and even made smaller, the wiring density of the wires can be reduced, as well as the size and bending degree of the bent wires. Thus, the height and width of the whole connector assembly are reduced, and the performance and quality of the connector assembly are improved.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector assembly, comprising:

a circuit board having a front side and a back side, a longitudinal edge of the circuit board is formed with a notch recessed inwardly;

two first connectors mounted side by side on the front side of the circuit board; and a cable having an end extending to a position under the back side of the circuit board, and a plurality of wires divided into two groups, each of the groups of wires arranged in a respective row and welded to respective rows of first and second welding pads on the circuit board so as to be electrically connected on one end to a respective one of the first connectors via the circuit board, a first one of the two groups of wires of the cable passes through the notch while extending from the back side to the front side of the circuit board to be welded to the row of first welding pads.

2. The connector assembly according to claim 1, wherein the wires are electrically connected to the first connectors via conductive traces on the circuit board.

3. The connector assembly according to claim 2, wherein a second one of the two groups of wires is welded to the row of second welding pads on the back side of the circuit board.

4. The connector assembly according to claim 3, further comprising two insulation cladding bodies molded on the circuit board to clad a respective one of the first welding pads and the second welding pads.

5. The connector assembly according to claim 1, further comprising a fixing clip installed on the back side of the circuit board and configured to fix the one end of the cable onto the back side of the circuit board.

6. The connector assembly according to claim 1, further comprising a second connector connected to a second end of the cable and electrically connected to the two first connectors via the cable and the circuit board.

7. The connector assembly according to claim 1, wherein the circuit board has a length direction and a width direction, and each of the two first connectors is elongated and extends along the length direction of the circuit board.

8. The connector assembly according to claim 7, wherein the cable extends along the length direction of the circuit board to reach the position under the back side of the circuit board, and each group of wires of the cable is bent so that it extends from the one end of the cable along a curved path, which is approximately perpendicular to the length direction of the circuit board, to reach a position above the circuit board.

9. The connector assembly according to claim 8, wherein a curved portion of each group of wires of the cable extending along the curved path has a height of not greater than 15 mm in a direction perpendicular to the circuit board.

10. The connector assembly according to claim 7, wherein the two first connectors are separated by a predetermined distance not greater than 20.32 mm.

11. The connector assembly according to claim 10, wherein the predetermined distance is equal to 20.32 mm, 20 mm, 19 mm, 18 mm, 17 mm, 16 mm or 15 mm.

12. The connector assembly according to claim 7, wherein the width of the whole connector assembly in the width direction of the circuit board is not greater than 39.5 mm.

13. The connector assembly according to claim 12, wherein the width of the whole connector assembly in the width direction of the circuit board is equal to 39.5 mm, 38 mm, 36 mm, 34 mm, 32 mm or 30 mm.

14. A connector assembly, comprising:

a circuit board;

a first connector and a second connector arranged in parallel on a first side of the circuit board and extending in a longitudinal direction of the circuit board; and a cable including a plurality of wires fixed to a second side of the circuit board, the plurality of wires being exposed under the second side of the circuit board and diverging into a first group of wires and a second group of wires, the first group of wires attaching to the second side of the circuit board and the second group of wires attaching to the first side of the circuit board.

15. The connector assembly according to claim 14, wherein the circuit board defines a notch formed in a lateral edge thereof and extending in the longitudinal direction, the second group of wires extending through the notch and attaching to the first side of the circuit board.

16. The connector assembly according to claim 15, further comprising a plurality of insulation cladding bodies molded on the first side and the second side of the circuit board for cladding welded portions of the first and second groups of wires.

17. The connector assembly according to claim 16, wherein a first cladding body is formed between the first and second connectors on the first side of the circuit board, and a second cladding body is formed adjacent the notch on the first side of the circuit board.

18. The connector assembly according to claim 15, wherein the first and second connectors are aligned longitudinally with the notch and are arranged laterally offset with respect to a center of the circuit board in a direction away from the notch.

19. A connector assembly, comprising:

a circuit board having a front side and a back side, and defining a recess formed therein;

two first connectors mounted side by side and separated from one another on the front side of the circuit board; and a cable including a plurality of wires at least partially exposed under the back side of the circuit board and diverging into two groups each having ends electrically connected to a respective one of the two first connectors, the two groups of wires including:

a first group of wires extending from the back side of the circuit board to the front side at least partially through the recess and electrically connecting to a first one of the two first connectors; and a second group of wires electrically connecting to a second one of the two first connectors on the back side of the circuit board.

20. The connector assembly according to claim 19, wherein each of the first and second groups of wires is connected to a row of welding pads formed on the front side and the back side of the circuit board, respectively.

* * * * *